US010247127B2

(12) United States Patent
Guerrassi

(10) Patent No.: US 10,247,127 B2
(45) Date of Patent: Apr. 2, 2019

(54) HYBRID FUEL INJECTION EQUIPMENT

(71) Applicant: DELPHI TECHNOLOGIES IP LIMITED, St. Michael (BB)

(72) Inventor: Noureddine Guerrassi, Vineuil (FR)

(73) Assignee: DELPHI TECHNOLOGIES IP LIMITED (BB)

( * ) Notice: Subject to any disclaimer, the term of this patent is extended or adjusted under 35 U.S.C. 154(b) by 161 days.

(21) Appl. No.: 15/022,235

(22) PCT Filed: Aug. 27, 2014

(86) PCT No.: PCT/EP2014/068161

§ 371 (c)(1),
(2) Date: Mar. 16, 2016

(87) PCT Pub. No.: WO2015/036243

PCT Pub. Date: Mar. 19, 2015

(65) Prior Publication Data

US 2016/0230694 A1 Aug. 11, 2016

(30) Foreign Application Priority Data

Sep. 16, 2013 (GB) ..... 1316439

(51) Int. Cl.
*F02M 63/00* (2006.01)
*F02D 41/38* (2006.01)
(Continued)

(52) U.S. Cl.
CPC ..... *F02D 41/3854* (2013.01); *F02D 41/12* (2013.01); *F02D 41/3082* (2013.01);
(Continued)

(58) Field of Classification Search
CPC .. F02D 41/3854; F02D 41/12; F02D 41/3082; F02D 41/123; F02D 2200/0602;
(Continued)

(56) References Cited

U.S. PATENT DOCUMENTS 5,456,233 A * 10/1995 Felhofer ..... F02M 55/025 123/447
5,678,521 A * 10/1997 Thompson ..... F02M 63/00 123/446
(Continued)

FOREIGN PATENT DOCUMENTS

DE 102005062548 A1 7/2007
DE 102011101861 A1 11/2012
(Continued)

OTHER PUBLICATIONS

International Search Report dated Oct. 28, 2014.

*Primary Examiner* — Hai H Huynh
*Assistant Examiner* — Gonzalo Laguarda
(74) *Attorney, Agent, or Firm* — Joshua M. Haines

(57) ABSTRACT

A fuel injection equipment for an internal combustion engine is piloted by a central electronic unit, the equipment includes a piloted low pressure pump drawing the fuel from a low pressure tank and sending the fuel toward a piloted inlet valve controlling the inlet of a high pressure pump which pressurizes the fuel and sends it pressurized toward a manifold to which is connected at least one injector. The equipment also includes a high pressure accumulator, distinct from the manifold, and a piloted high pressure valve in fluid communication between the outlet of the high pressure pump and the manifold so that the high pressure accumulator stores and delivers pressurized fuel to the manifold.

12 Claims, 2 Drawing Sheets

(51) Int. Cl.
*F02M 63/02* (2006.01)
*F02D 41/30* (2006.01)
*F02D 41/12* (2006.01)

(52) U.S. Cl.
CPC ..... *F02M 63/0003* (2013.01); *F02M 63/02* (2013.01); *F02M 63/0275* (2013.01); *F02M 63/0285* (2013.01); *F02D 41/123* (2013.01); *F02D 2200/0602* (2013.01); *F02M 2200/40* (2013.01); *F02M 2200/60* (2013.01)

(58) Field of Classification Search
CPC ..... F02D 2200/40; F02D 2200/60; F02M 63/0003; F02M 63/02; F02M 63/0275; F02M 63/0285
See application file for complete search history.

(56) References Cited

U.S. PATENT DOCUMENTS

| | | | | |
|---|---|---|---|---|
| 6,223,725 | B1 | 5/2001 | Onishi et al. | |
| 6,234,128 | B1 * | 5/2001 | Reuss | F02M 37/04 123/179.17 |
| 6,405,710 | B1 | 6/2002 | Brehob et al. | |
| 6,497,217 | B2 | 12/2002 | Kojima | |
| 7,493,893 | B2 * | 2/2009 | Funabashi | F02D 33/006 123/457 |
| 7,640,916 | B2 * | 1/2010 | Ulrey | F02D 33/003 123/446 |
| 8,607,764 | B2 * | 12/2013 | Judge | F02M 55/025 123/456 |
| 8,683,981 | B2 | 4/2014 | Uryu et al. | |
| 2011/0106393 | A1 | 5/2011 | Pursifull | |
| 2011/0251776 | A1 * | 10/2011 | Bartell | F02M 69/045 701/103 |
| 2013/0138327 | A1 | 5/2013 | Kojima | |

FOREIGN PATENT DOCUMENTS

| | | | |
|---|---|---|---|
| EP | 0699835 | A1 | 3/1996 |
| EP | 889233 | A2 | 1/1999 |
| GB | 2277556 | A1 | 11/1994 |
| JP | 58-18062 | U1 | 2/1983 |
| JP | 01-159458 | A | 6/1989 |
| JP | 10018933 | A | 1/1998 |
| JP | 63-090658 | A | 4/1998 |
| JP | H11236861 | A1 | 8/1999 |
| JP | 2001107822 | A | 4/2001 |
| JP | 2003-035182 | A | 2/2003 |
| JP | 2005-299512 | A | 10/2005 |
| JP | 2006-336593 | A | 12/2006 |
| JP | 2007-247440 | A | 9/2007 |
| JP | 2010024849 | A1 | 2/2010 |
| JP | 2011144744 | A1 | 7/2011 |
| JP | 2013130196 | A1 | 7/2013 |

* cited by examiner

HYBRID FUEL INJECTION EQUIPMENT

CROSS REFERENCE TO RELATED APPLICATIONS

This application is a national stage application under 35 USC 371 of PCT Application No. PCT/EP2014/068161 having an international filing date of Aug. 27, 2014, which is designated in the United States and which claimed the benefit of GB Patent Application No. 1316439.7 filed on Sep. 16, 2013, the entire disclosures each are hereby incorporated by reference in their entirety.

TECHNICAL FIELD

The present invention relates to a hybrid fuel injection equipment enabling energy recuperation when in foot-off mode.

BACKGROUND OF THE INVENTION

Diesel fuel injection equipment, such as common rail system, equip all modern diesel engines. In these systems, an electric pump sucks the fuel from the fuel tank and sends it to a high pressure pump then, to the common rail that feeds all injectors. The high pressure pump is typically driven by the engine crankshaft and its inlet and outlet are controlled by valves. When the engine is requested to accelerate, in a so-called "foot-on" mode, the pressure inside the common rail is at its highest level and, to the opposite, when the engine decelerates, in "foot-off" mode the fuel is injected at a much lower pressure. Consequently the pressure in the rail raises and decreases quickly and often. The decrease of the pressure is normally done by opening a high pressure valve letting the fuel at high pressure return to the fuel tank. The energy spent to pressurise this fuel is then lost.

SUMMARY OF THE INVENTION

Accordingly, it is an object of the present invention to provide a fuel injection equipment for an internal combustion engine. The equipment is piloted by a central electronic unit and it comprises a piloted low pressure pump drawing the fuel from a low pressure tank and sending the fuel toward a piloted inlet valve. Said piloted inlet valve pilots the inlet of a high pressure pump which pressurises the fuel and sends it pressurised toward a manifold, to which is connected at least one injector. The equipment further comprises a high pressure accumulator means, distinct from the manifold, and a piloted high pressure valve arranged in fluid communication between the outlet of the high pressure pump and the manifold, so that the high pressure accumulator means stores and delivers pressurised fuel to the manifold.

The low pressure pump is an electric pump only driven when the pressure inside the accumulator falls below a predetermined threshold.

Alternatively the low pressure pump can be a mechanical pump permanently driven, a bypass channel controlled by a piloted valve being arranged to enable or prevent the fuel to enter said mechanical pump.

In a further alternative, the mechanical pump may be provided with a switchable means, such as a piloted clutch, enabling to disengage the pump from its driving means.

According to an embodiment, the manifold is a common rail feeding in parallel a plurality of injectors. The equipment further comprises a second high pressure valve arranged on the rail and provided with a return low pressure line leading to the tank.

Also, the equipment further comprises a one-way valve arranged between the high pressure pump and the accumulator, said one-way valve forbidding the fuel pressurised in the accumulator to flow back to the high pressure pump when the high pressure pump is stopped.

The equipment further comprises a bypass channel connecting directly the high pressure pump to the manifold. A control valve normally closed arranged in said bypass channel, said control valve solely opening when the pressure of the fuel needed in the manifold, is superior to the pressure of the fuel in the accumulator means, for instance at cold start.

The invention is also related to an engine management control process for controlling fuel injection equipment as described in the prior paragraphs. The process comprises the step of entering an energy saving mode by stopping the low pressure pump when the accumulator pressure is superior to a pressure threshold. Then, the accumulator means delivers the necessary fuel at the necessary pressure to the injectors. The threshold can either be constant or fixed and predetermined or, can be variable and constantly adapted as being the pressure at which the fuel must be injected.

Furthermore, the energy saving mode comprises the step of:

determining the operation mode of the engine and, if the engine operates on "foot-off" mode and comparing the accumulator pressure to the threshold.

Also, the process exits the energy saving mode by actuating the low pressure pump if the accumulator pressure falls below the threshold. In the particular case of a variable threshold, the low pressure pump could be actuated when the decreasing accumulator pressure approached too closely the pressure at which the fuel must be injected.

The process further comprises the step of running the low pressure pump so the accumulator means builds-up in pressure if at the determining step the operation mode of the engine is identified as "foot-on" and if the accumulator pressure is inferior to the pressure demanded for the injection.

BRIEF DESCRIPTION OF THE DRAWINGS

The present invention is now described by way of example with reference to the accompanying figures.

DESCRIPTION OF THE PREFERRED EMBODIMENTS

In the following description, similar elements will be designated with the same numeral reference.

Figure 1:
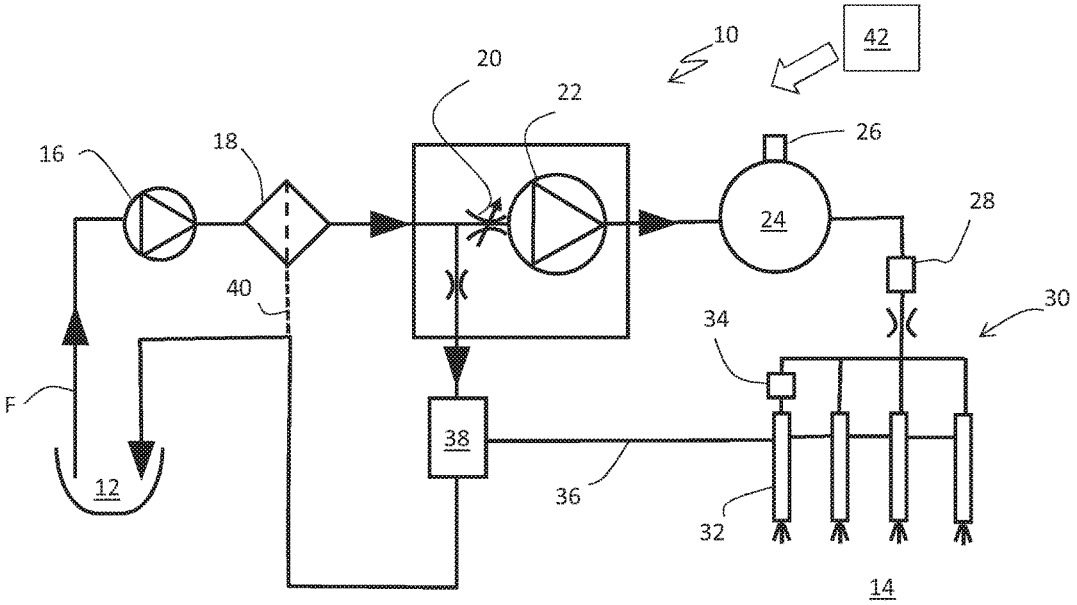
FIG. 1 is a first embodiment of the fuel injection equipment as per the invention.

FIG. 1 is a representation of a first embodiment of a fuel injection equipment (FIE) 10 wherein fuel circulates from a tank 12 to the combustion chambers 14 of an internal combustion engine. Described in following the fuel flow, the FIE 10 comprises the low pressure tank 12 where fuel is sucked by a low pressure electric pump 16 and sent at a low pressure, approximately three to five bars, through a filter 18 then toward a piloted inlet valve 20 that controls the inlet of a high pressure pump unit 22. In the high pressure pump 22 the fuel is highly pressurised, at several hundred bars, and is then sent to a high pressure accumulator means 24. Said accumulator means 24 may for instance be a reservoir internally divided by a soft membrane. The pressurized fuel fills one side while a pressurised gas fills the other side of the membrane. Multiple alternatives can be imagined for such accumulator 24. The pressure of the fuel inside the accumulator means 24 is monitored by a pressure sensor 26. The outlet of the accumulator means 24 is controlled by a piloted high pressure valve 28 that opens into a manifold 30 distributing the fuel to the injectors 32. In FIG. 1 four injectors are sketched but another quantity can of course be arranged. Another pressure sensor 34 monitors the pressure inside the manifold 30.

A low pressure return line 36 is arranged between all the injectors 32 and the tank 12. In said line 36, the fuel which has not been injected in the combustion chambers 14 returns to the low pressure tank 12. The low pressure return line 36 comprises also a back leak pressure regulator 38 where arrives a line from the high pressure pump 22. A fuel line 40 is arranged between the filter 18 and said return line 36 so, for instance at cold start, to quickly heat the fuel at the high pressure pump inlet 22.

An electronic control unit 42 receives information signals from all sensors involved in the operation of the engine and, sends command signals to all piloted component for the FIE 10 of the engine.

Figure 2:
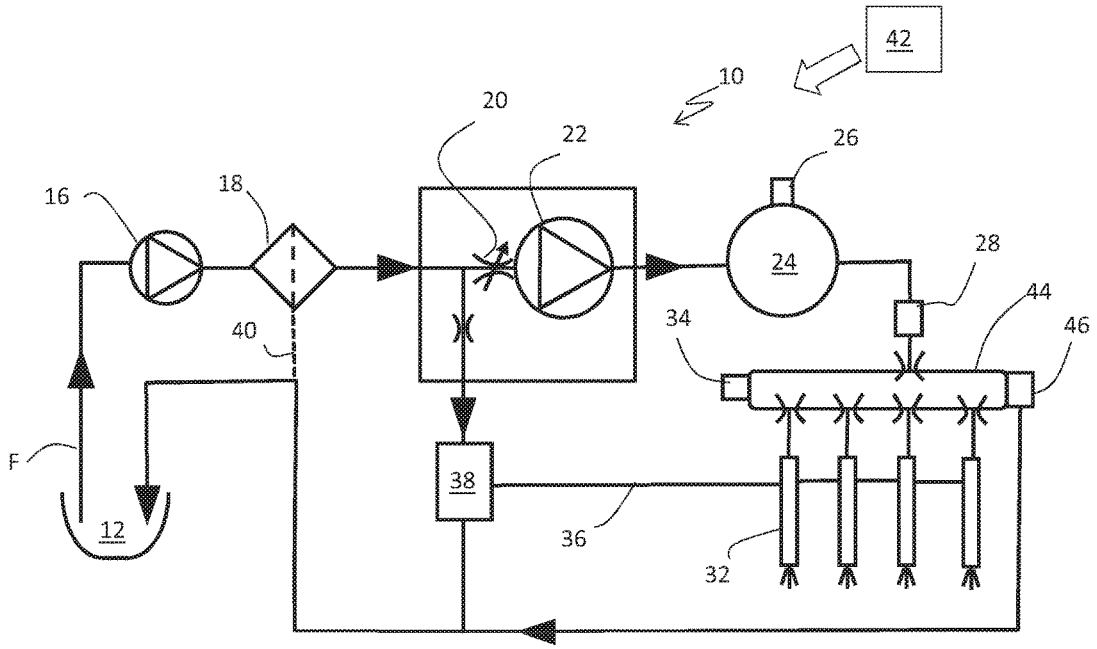
FIG. 2 is a second embodiment of a fuel injection equipment as per the invention.

FIG. 2 is a representation of a second embodiment of the FIE 10. The main difference between the second embodiment and the first embodiment is that the manifold 30 is replaced by a well-known common rail 44. Said another pressure sensor 34 now monitors the pressure inside the rail 44 and, a second high pressure valve 46 arranged on the rail 44 can be open to enable the fuel in overpressure in the rail 44 to flow back to the low pressure tank 12 via another return line.

A process 100 of operation of the FIE 10 is now described with reference to FIG. 3. The process 100 applies to both embodiments here above described.

After starting the engine in the initial step 100, the process comprises a first alternative step 110 where the engine condition is determined. In said alternative step 110 is especially determined whether the fuel to be injected is demanded a high pressure, the engine being on "foot-on" mode, or if no injection is required when the engine is in deceleration in "foot-off" mode. Is this description "foot-off" and "foot-on" designate the action of the driver on the throttle pedal and, the engine operation mode implied by this action. When the driver wants to accelerate, he is on "foot-on" and the fuel injected is at high pressure. To the contrary when for instance going downhill on engine brake the driver is "foot-off" and the fuel injected is at a low pressure just to maintain the engine running at idle speed.

During the first alternative step 110 if the engine condition corresponds to a "foot-off" mode then the process 100 proceeds to a second alternative step 120. In FIG. 3 this is symbolised by the numeral "1" written close to the link between alternative steps 110 and 120. When the engine is on foot-off mode the engine speed decreases to reach the idle speed. To maintain the idle speed and to prevent the engine from stopping and also to be ready for acceleration, fuel at low pressure is injected.

In the second alternative step 120 the actual engine speed is compared to the idle speed. If the engine speed exceeds the idle speed, link "1" then, no injection is required and the engine continues on foot-off mode and the process continues in a third alternative step 130.

In the third alternative step 130 the accumulator pressure Pacc, measured by the pressure sensor 26, is compared to a predetermined pressure threshold P1 memorised in the control unit 42. The threshold P1 is chosen to be close, but slightly lower, than the maximum operational pressure Pmax of the FIE 10. In an alternative, the threshold pressure P1 could be the maximum operational pressure Pmax of the FIE 10. Distinguishing both pressures P1 and Pmax enables a range within which the accumulator pressure can evolve. If the accumulator pressure Pacc is smaller than the threshold P1 than the process 100 interprets that the accumulator pressure Pacc is insufficient than it proceeds to step 140, link "1". In step 140 the control unit 42 sends running command signals to the low pressure pump 16 and to the inlet piloted valve 20 which consequently enable fuel to be sucked from the tank 12 and directed to the high pressure pump 22, then to the accumulator means 24 and, consequently the accumulator pressure Pacc raises. This running command signal is sent as long as the accumulator pressure Pacc is inferior the threshold P1. In FIG. 3 this is symbolized by the loop between the steps 130 and 140.

As this happens in "foot-off" mode, there is no injection and the first and second high pressure valves 28, 46, and the injectors 32 are closed.

To the contrary, while still being in "foot-off" mode, if during the third alternative step 130, the accumulator pressure Pacc is measured equal or superior to the threshold P1, the control unit 42 sends turn off signals to the low pressure pump 16 and to the piloted valve 20 saving the energy normally utilized by the pump 16. From the third alternative step 130, the process proceeds, link "0", back to the first alternative step 110.

The mode here above described is an energy saving mode ESM wherein the low pressure pump 26 is stopped when the accumulator pressure Pacc is sufficient. In this case, the process 100 follows a loop between steps 110, 120, 130.

To the contrary, if the accumulator pressure Pacc is insufficient, the low pressure pump 26 is actuated, process 100 adding a loop between the steps 130-140, until the accumulator pressure Pacc reaches the threshold P1 and, at that point process 100 returns to step 110.

In the above paragraphs, the threshold P is described fixed, constant and predetermined. It is memorized in the control unit 42.

Alternatively, the threshold P can be variable and equal to the pressure demanded Pdem by the injectors. As long as the accumulator pressure Pacc is sufficient to deliver said demanded pressure Pdem, the process remains in the energy saving mode ESM.

During the first alternative step 110 if the engine condition corresponds to a "foot-on" mode, to the contrary of the preceding paragraphs, then process 100, step 110—link "0", proceeds to a fourth alternative step 150 where the pressure demanded Pdem for injection is compared to the accumulator pressure Pacc.

In the fourth alternative step 150, if the pressure demanded Pdem is inferior to the accumulator pressure Pacc then,—link "1", the process 100 proceeds to a step 170 where an opening signal is send to the high pressure valve 28 that controls the outlet of the accumulator means 24 therefore flowing high pressure fuel toward the injectors 32 and proceeding to an injection event in step 200.

If, to the contrary the pressure demanded Pdem is superior to the accumulator pressure Pacc then, link "0", the process 100 proceeds to a step 160 where the control unit 42 sends running command signals to the low pressure electric pump 16 and to the inlet piloted valve 20 and, consequently, fuel is sucked from the tank 12 and is directed to the high pressure pump 22 then to the injectors 32 via the accumulator means 24.

Figure 3:
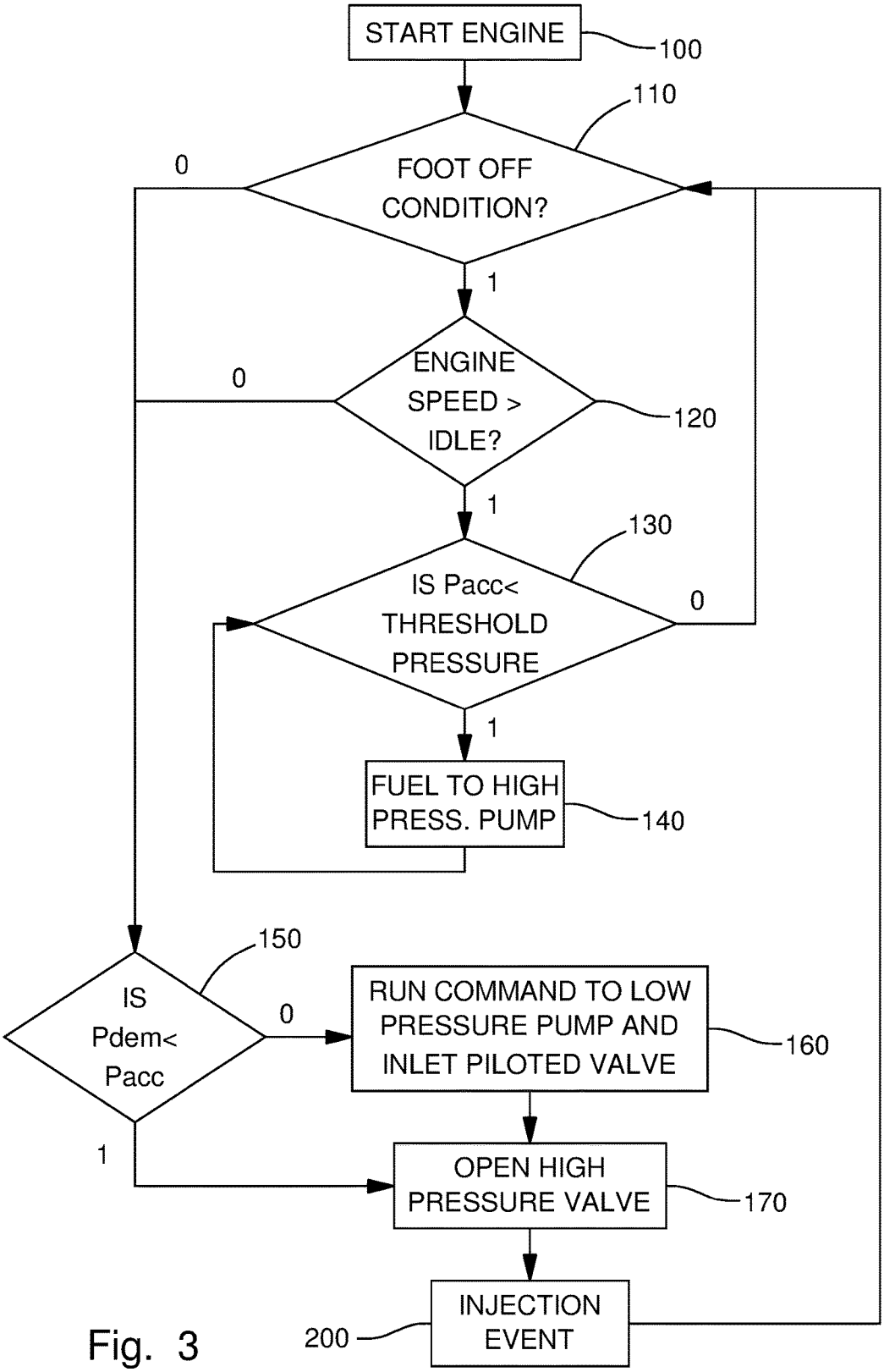
FIG. 3 is a process of operation of the fuel injection equipment.

Summarizing the "foot-on" mode, in reference to FIG. 3, the process 100 follows the steps 110, 150 and, if the accumulator pressure Pacc is sufficient the process stops actuating the low pressure pump 26 entering the energy saving mode ESM. The fuel inside the accumulator means 24 is then released—170—toward the injector to proceed to an injection event—200.

To the contrary, if the accumulator pressure Pacc is too low than—160—the low pressure pump 26 is actuated and fuel is sucked from the tank and pressurized prior to be sent to the injectors to proceed to an injection—200.

In an alternative embodiment not represented the low pressure pump 16, which was previously described as an electric pump, can be replaced by a mechanical pump. Furthermore, it can be mechanically integrated with the high pressure pump and directly driven by the engine.

In this mechanical alternative, the low pressure pump cannot be stopped in foot-off mode, as previously described, but its energy consumption is important only when fuel is sucked. To provide the energy saving mode ESM and similar advantageous results, a fluid bypass controlled by a piloted valve can be arranged around the mechanical low pressure pump. Therefore, when the bypass is closed and the fuel is normally sucked from the tank and sent to the high pressure pump and, in ESM mode, the bypass is open and no fuel is sucked, the mechanical pump rotates in consuming a minimum energy. Instead of a bypass channel, the mechanical pump can be provided with a piloted clutch that would couple or de-couple the pump from its driven means.

The invention claimed is:

1. A fuel injection equipment for an internal combustion engine, the fuel injection equipment being controlled by a central electronic unit, the fuel injection equipment comprising:

a low pressure pump drawing fuel from a tank and sending the fuel toward an inlet valve controlling an inlet of a high pressure pump which pressurises the fuel and sends it pressurised toward a manifold to which is connected at least one injector;

a high pressure accumulator means, distinct from the manifold; and a high pressure valve arranged in fluid communication between an outlet of the high pressure pump and the manifold so that the high pressure accumulator means stores and delivers pressurised fuel to the manifold; wherein the high pressure valve is located in series between the high pressure pump and the manifold such that the high pressure valve includes a high pressure valve inlet which is downstream from, and receives fuel from, the high pressure pump, and also includes a high pressure valve outlet which is downstream of the high pressure valve inlet and which communicates fuel to the manifold;

wherein the low pressure pump is an electric pump only driven when the pressure inside the high pressure accumulator means falls below a predetermined threshold and is stopped when the pressure inside the high pressure accumulator means is over the predetermined threshold; and wherein fluid communication from the high pressure pump to the manifold is always through the high pressure accumulator means.

2. The fuel injection equipment as set in claim 1 wherein the manifold is a common rail feeding in parallel a plurality of injectors, the fuel injection equipment further comprising a second high pressure valve arranged on the common rail and provided with a return low pressure line leading to the tank.

3. The fuel injection equipment as set in claim 1 further comprising a one-way valve arranged between the high pressure pump and the high pressure accumulator means, said one-way valve forbidding the fuel pressurised in the high pressure accumulator means to flow back to the high pressure pump when the high pressure pump is stopped.

4. An engine management control process for controlling the fuel injection equipment as set in claim 1, the engine management control process comprising the step of entering an energy saving mode by stopping the low pressure pump when the pressure of the high pressure accumulator means is superior to a pressure threshold, the high pressure accumulator means delivering the necessary fuel at the necessary pressure to the at least one injector.

5. The engine management control process as set in claim 4 wherein the pressure threshold is constant and predetermined.

6. The engine management control process as set in claim 4 wherein the pressure threshold is variable as being a pressure at which the fuel must be injected.

7. The engine management control process as set in claim 4, wherein the energy saving mode comprises a step of determining an operation mode of the engine and, if the engine operates on a foot-off mode, comparing the pressure of the high pressure accumulator means to the pressure threshold.

8. The engine management control process as set in claim 7 further comprising a step of running the low pressure pump so that the high pressure accumulator means increases in pressure if at the step of determining an operation mode of the engine is identified as foot-on and if the pressure of the high pressure accumulator means is inferior to the pressure demanded for injection.

9. The engine management control process as set in claim 4 further comprising a step of exiting the energy saving mode by actuating the low pressure pump if the pressure of the high pressure accumulator means falls below the pressure threshold.

10. The fuel injection equipment as set in claim 1, wherein the high pressure accumulator means is located in series between the high pressure pump and the manifold.

11. The fuel injection equipment as set in claim 10, wherein the high pressure accumulator means includes an accumulator inlet which is downstream from, and receives fuel from, the high pressure pump and also includes an accumulator outlet which is downstream from the accumulator inlet.

12. The fuel injection equipment as set in claim 11, wherein the high pressure valve inlet receives fuel from the accumulator outlet.

* * * * *